US007982402B2

(12) United States Patent
Johnsen et al.

(10) Patent No.: US 7,982,402 B2
(45) Date of Patent: Jul. 19, 2011

(54) INTEGRATED IGNITER BASE FOR CERAMIC METAL HALIDE LIGHT SOURCE

(75) Inventors: Andrew Johnsen, Danvers, MA (US); Glenn Freeman, Danvers, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 461 days.

(21) Appl. No.: 12/209,732

(22) Filed: Sep. 12, 2008

(65) Prior Publication Data

US 2010/0066247 A1 Mar. 18, 2010

(51) Int. Cl.
*H01K 1/62* (2006.01)

(52) U.S. Cl. ..... 315/57; 315/56; 315/157; 315/209 R; 315/246; 315/291; 313/25; 313/113; 313/114; 313/623

(58) Field of Classification Search ..... 315/56, 315/57, 58, 157, 209 CD, 209 R, 246, 291, 315/307; 313/25, 113, 114, 623
See application file for complete search history.

(56) References Cited

U.S. PATENT DOCUMENTS

| | | | | |
|---|---|---|---|---|
| 5,585,697 | A * | 12/1996 | Cote et al. | 315/157 |
| 6,111,359 | A * | 8/2000 | Work et al. | 315/56 |
| 7,271,545 | B2 * | 9/2007 | Hu et al. | 315/209 CD |
| 7,339,330 | B2 | 3/2008 | Brates et al. | |
| 7,772,750 | B2 * | 8/2010 | Lovett et al. | 313/113 |

* cited by examiner

*Primary Examiner* — Douglas W Owens
*Assistant Examiner* — Thai Pham
(74) *Attorney, Agent, or Firm* — Shaun P. Montana

(57) ABSTRACT

A PAR38 light source assembly for use with a fixture having PAR38 socket connected to a ballast circuit for generating a ballast voltage. An electrically insulating housing supports a PAR38 screw base and encloses a CMH lamp and a circuit board providing a high voltage to ignite or re-ignite the lamp. The housing supports a reflector a lens wherein the lens, the reflector and the housing form an electrically insulating enclosure so that the PAR38 screw base is the only electrically conductive portion.

20 Claims, 5 Drawing Sheets

INTEGRATED IGNITER BASE FOR CERAMIC METAL HALIDE LIGHT SOURCE

FIELD OF THE INVENTION

The present invention generally relates to a ceramic metal halide light source and in particular such a light source having an internal high voltage circuit for starting and restarting the light source.

BACKGROUND OF THE INVENTION

A high intensity discharge (HID) device such as a ceramic metal halide (CMH) lamp within a light source is usually connected to a ballast which is located within a fixture for receiving the device. The ballast supplies a moderate ballast voltage which is stepped up to about 3 kV to ignite gases within the CMH lamp to illuminate the lamp. Once the lamp has been energized, the gases become hot. If the device becomes de-energized, it is difficult to re-ignite the gases and re-start the device using the ballast voltage. Generally, a higher voltage of upwards of 25 kV is needed. To supply such a high voltage via the ballast creates safety concerns. There is a need for a device which can re-ignite and re-start which does not require a ballast to supply a high voltage.

SUMMARY OF THE INVENTION

In one form, the invention comprises a standard light source assembly, such as a PAR38, for use with a fixture having a standard socket connected to a ballast circuit for generating a ballast voltage. An electrically insulating housing supports a PAR38 screw base and encloses a CMH lamp and a circuit board providing a high voltage to ignite or re-ignite the lamp with a high voltage. The housing supports a reflector a lens wherein the lens, the reflector and the housing form an electrically insulating enclosure so that the PAR38 screw base is the only electrically conductive portion. The high voltage for energizing or re-energizing the lamp is contained within the electrically insulated housing and none of the high voltage is external to the light source assembly.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
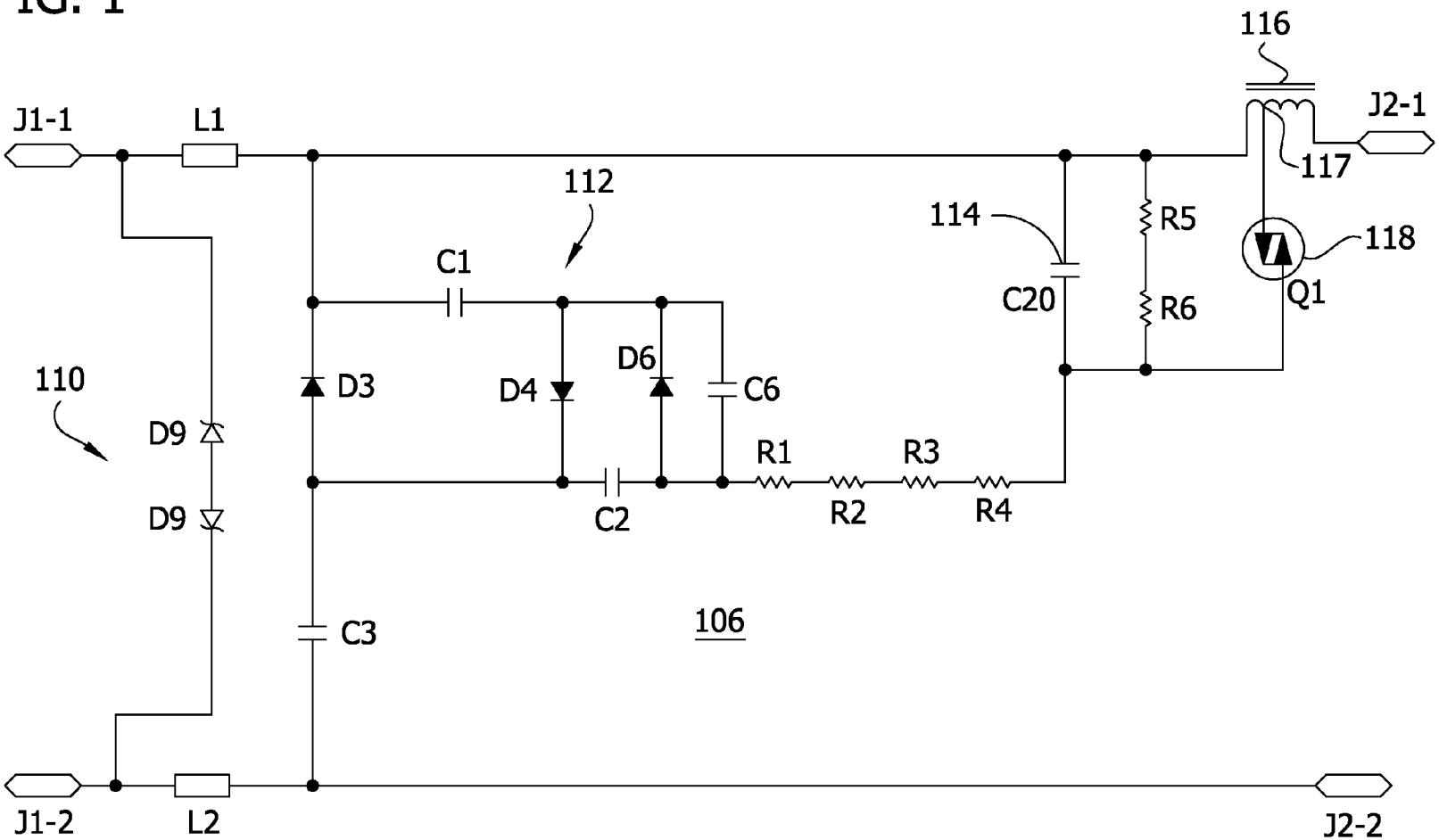
FIG. 1 is a schematic diagram of a circuit according to one embodiment of the invention.

The present invention is employs a voltage doubler and a surface mounted capacitor electrically insulated within a light source having a standard socket, such as a screw base and a socket compatible with a parabolic aluminized reflector (PAR) standard (e.g., PAR38). As a result, all high voltages are generated and kept within the base of the light source.

Referring to the figures, a PAR38 light source assembly 100 for use with a fixture is illustrated as one embodiment of the invention. Reference characters J1-1 and J1-2 are inputs connected to a PAR38 screw base 102 for engaging a PAR38 socket (not shown) connected to a ballast circuit (not shown) for generating a ballast voltage of about 1 kV. The screw base 102 conducts the ballast voltage when the screw base engages the socket. A ceramic metal halide (CMH) lamp 104 to be illuminated is connected to outputs J2-1 and J2-2. Thus, one aspect of the invention comprises a two-terminal output J2-1, J2-2 for energizing the CMH lamp 104 interconnect the igniter circuit 112 and the lamp 104.

FIG. 1 illustrates a open circuit high voltage igniter circuit 106 on a circuit board 108 for selectively starting or restarting the lamp 104. The igniter circuit 106 includes clamping diodes 110 connected to the inputs J1-1 and J1-2 to reduce high voltage transients. A voltage multiplier circuit 112 connected to the screw base via inputs J1-1 and J1-2 receives the ballast voltage of about 150 Vrms and multiplies the voltage to a multiplied voltage to about 1 kV. A storage capacitor 114 such as a metal film capacitor stores the multiplied voltage of about 1 kV and is connected to a transformer 116 which steps up the voltage stored by the capacitor 114 to about 25 kV. The transformer 116 is connected to output J2-1 so that it is between the voltage multiplier 112 and the lamp 104 to supply the stepped up voltage to energize or re-energize the lamp 104.

A spark gap device 118 is connected to one of the taps 117 of the transformer 116. The spark gap device 118 is connected between the transformer 116 and the capacitor 114 for selectively discharging the stored, multiplied voltage of the capacitor 114 via the transformer 116 to start (ignite; energize) or re-start (re-ignite; re-energize) the lamp 104. The spark gap device 118 discharges at a preset discharge or firing voltage which is generated when the lamp 104 is de-energized.

When the lamp 104 is de-energized and the igniter circuit 106 is energized, voltage builds on the capacitor 114 increasing the voltage applied to the transformer 116. When the voltage applied to the tap of the transformer 116 equals to or exceeds the firing voltage of the spark gap device 118, the spark gap device 118 discharges which closes the circuit between the transformer 116 and the capacitor 114. This results in the capacitor 114 discharging through the transformer 116 which steps up the voltage from 1 kV to 25 kV. The stepped up voltage is applied to the lamp 104 to energize or re-energize the lamp. When the lamp ignites, it lowers the voltage on the outputs J2-1 and J2-2 below the firing voltage of the spark gap device 118.

An electrically insulating reflector 120 surrounds the lamp 104 and supports an electrically insulating lens 122 engaging the reflector 120 so that the reflector 120 and the lens 122 enclose the lamp 104. An electrically insulating housing 124 supports the PAR38 screw base and encloses the CMH lamp 104 and the circuit board 108. The housing 124 also supports the reflector 120 and the lens 122. The lens 122, the reflector 120 and the housing 124 form an electrically insulating enclosure so that the PAR38 screw base 102 is the only electrically conductive portion.

Figure 2:
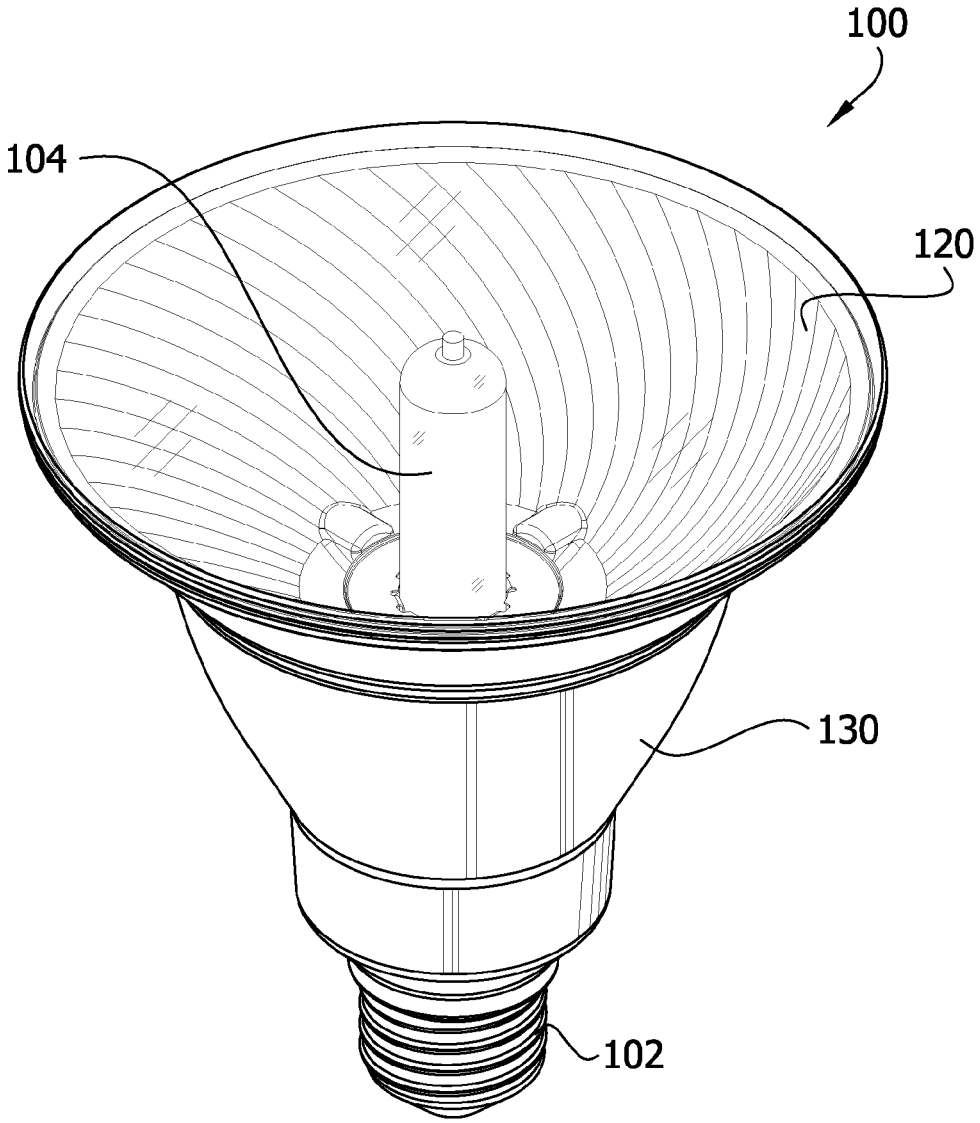
FIG. 2 is a perspective illustration of one embodiment of an assembled light source assembly of the invention wherein the high voltage for energizing or re-energizing a CMH lamp of the assembly is contained within an electrically insulated housing and none of the high voltage is external to the light source assembly.

FIG. 2 is a perspective illustration of one embodiment of an assembled light source assembly 100 of the invention. All high voltage for energizing or re-energizing the CMH lamp 104 of the assembly 100 is contained within the electrically insulated housing 124 and none of the high voltage is external to the light source assembly 100.

Figure 3:
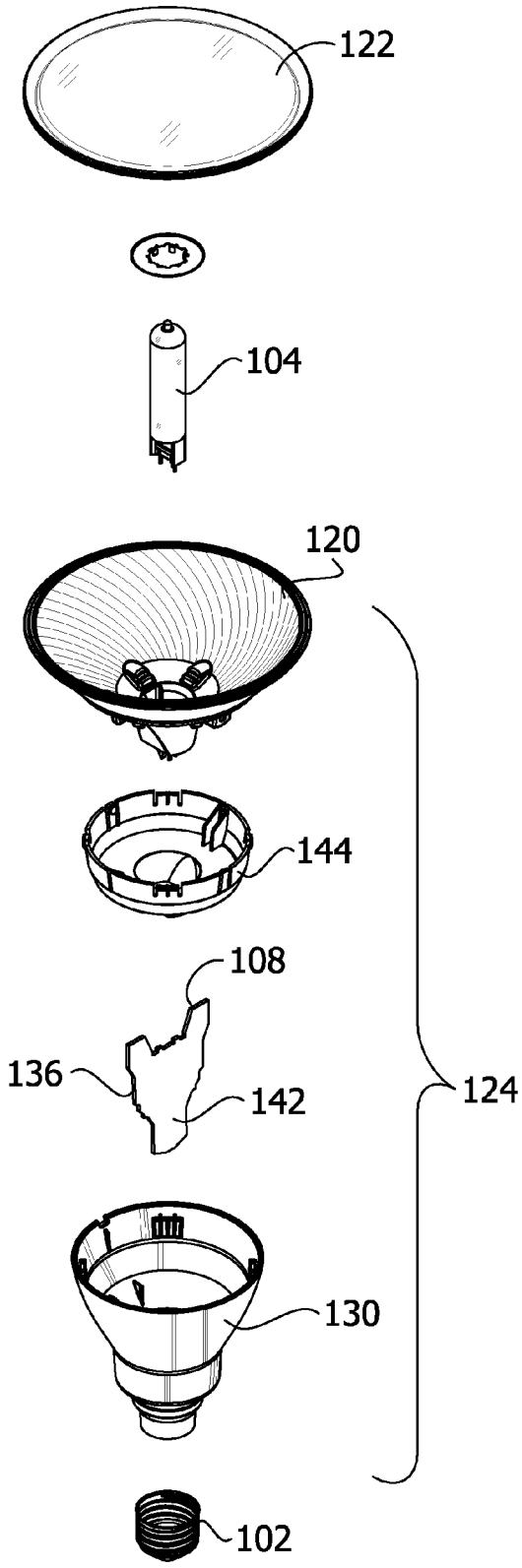
FIG. 3 is an exploded perspective illustration of one embodiment of the assembly of the invention showing the circuit board which is to be positioned within the base.

As shown in FIG. 3, in one embodiment the housing 124 of the light source assembly 100 includes a cone-shaped electrically non-conductive base 130 for receiving the circuit board 108 including the circuit of FIG. 1 and its components. As a result, the cone shaped base 130 defines an enclosure within which the circuit board 108 and substantially all components on the circuit board 108 are enclosed. The cone-shaped electrically non-conductive base 130 is configured to support the assembly 100 so that the circuit board 108 engages the base 130.

In one embodiment of the light source assembly 100, the base 130 comprises a non-conductive plastic sleeve supporting the circuit board 108. A disk 144 may be positioned between the reflector 120 and the circuit board for holding the circuit board in place relative to the reflector 120.

Mounting the capacitor 114 and the transformer very close to the lamp 104 minimizes losses in voltage and minimizes any arcing that would otherwise be likely to occur when the higher restart voltage is generated by the ballast within the fixture. In one embodiment, the lamp physically engages and electrically contacts the circuit board 108 supporting the capacitor 114 and the transformer 116 to minimize voltage losses and arcing.

The following Table 1 illustrates one preferred embodiment of the bill of materials for the circuit of FIG. 1 for mounting on circuit board 108:

| Quantity | Reference | Description | Part Number | Manufacturer |
|---|---|---|---|---|
| 1 | 114 (C20) | CAP-MKN-SMD 72n-10-1000 | HNSQF2700KACN0 | Arcotronics |
| 4 | C1-C3, C6 | CAP CER 20PF 10% 1500 V NP0 1210 | VJ1210A200KBRAT4X | Vishay |
| 1 | 110 (D9) | SEM-TVS-DIODE-SMD 423 V-600 W-DO214AA | P6SMB520C TRTB | Fagor |
| 3 | D3-D4, D6 | DIODE ULTRA FAST 1200 V 1 A SMB | STTH112U | ST Micro |
| 1 | 116 (T1) | MAG-CHOKE-IGNITOR MODULE | ZLM 1883283 | TDK |
| 2 | L1-L2 | MAG-EMI-SMD 15uH-FRAME CORE 5.8 × 9 × 2.9 | 00 6168 00 | NEOSID |
| 4 | R1-R4 | RES 20K OHM ¼ W 5% 1206 SMD | KTR18EZPJ203 | Rohm |
| 2 | R5-R6 | RES 3.3M OHM ¼ W 5% 1206 SMD | KTR18EZPJ335 | Rohm |
| 1 | 118 (Q1) | Spark Gap | FS08X-1JG | EPCOS |

Figure 4:
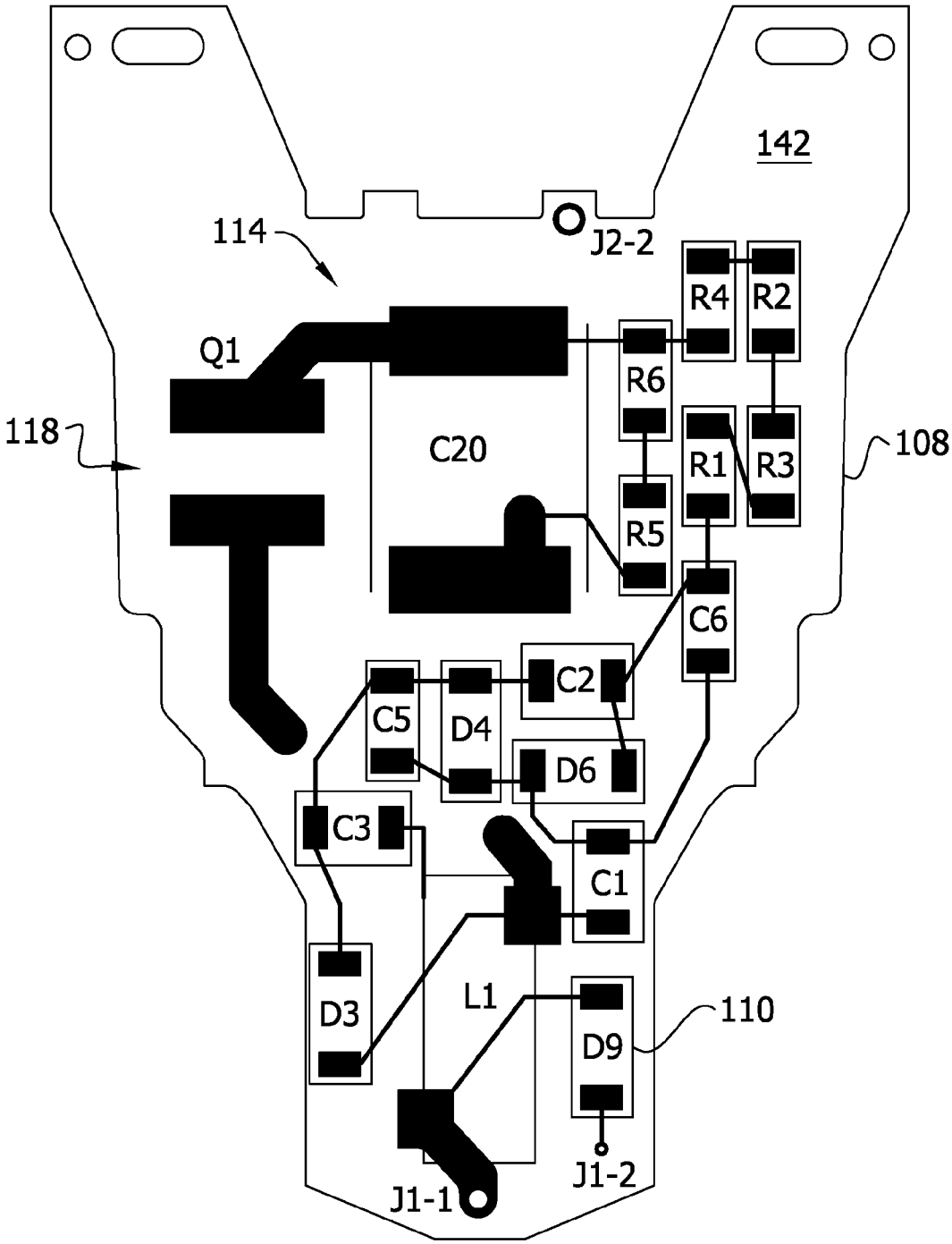
FIG. 4 is a plan view of one embodiment of one side of the circuit board of the invention.
Figure 5:
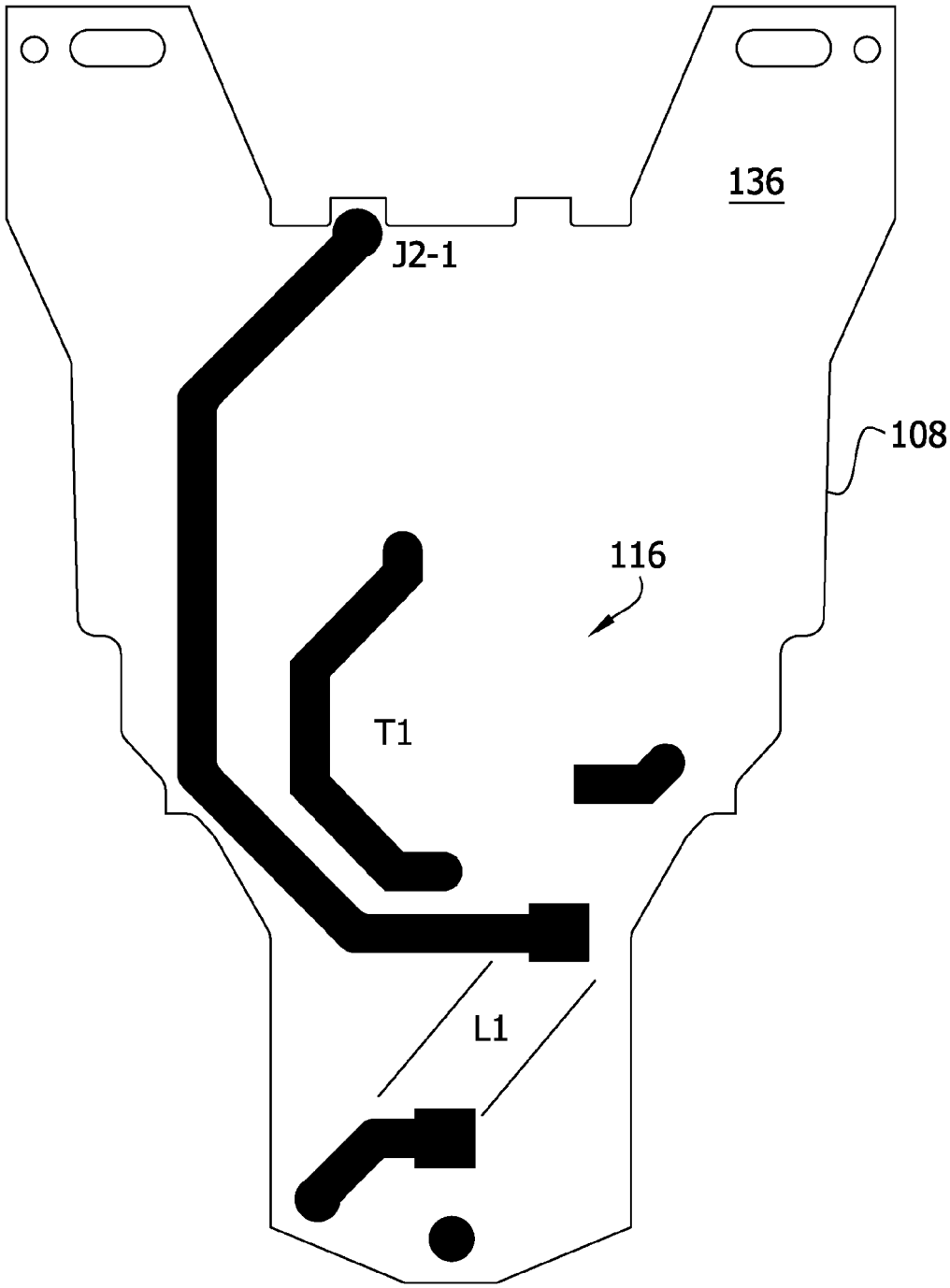
FIG. 5 is a plan view of one embodiment of one side of the circuit board of the invention.

FIGS. 4 and 5 illustrate the first side 136 and the second side 142 of the circuit board 108, respectively. The first side 136 includes the transformer 116. The second side 142 includes the storage capacitor 114 and the spark gap device 118, as well as the components for the voltage multiplier circuit 112. The remaining components (such as the resistors and diodes) may be located on either side, although it is contemplated in one embodiment that all components except the transformer 116 would be located on the second side 142 with the transformer 116 only on the first side 136.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A light source assembly for use with a fixture having a socket connected to an external ballast circuit for generating a ballast voltage, the light source assembly comprising:

a ceramic metal halide (CMH) lamp;

a screw base that engages the socket, to electrically connect the light source assembly to the external ballast circuit and to conduct the ballast voltage when the screw base engages the socket;

a circuit board having mounted thereon a igniter circuit electrically connected to the screw base to receive the ballast voltage from the external ballast circuit, the igniter circuit also electrically connected to the CMH lamp to selectively energize or re-energize the lamp with a high voltage generated by the igniter circuit using the ballast voltage received from the external ballast circuit via the screw base;

an electrically insulating reflector to receive the CMH lamp;

an electrically insulating lens supported by the reflector so that the reflector and the lens enclose the CMH lamp; and an electrically insulating housing supporting the screw base and enclosing the CMH lamp and the circuit board, the housing supporting the reflector and lens;

wherein the lens, the reflector and the housing form an electrically insulating enclosure so that the screw base is the only electrically conductive portion of the light source assembly; and wherein the high voltage to energize or re-energize the lamp is contained within the electrically insulated housing and none of the high voltage is external to the light source assembly.

2. The light source assembly of claim 1, wherein the igniter circuit comprises:

a voltage multiplier circuit connected to the screw base and receiving the ballast voltage, the voltage multiplier circuit to multiply the ballast voltage to a multiplied voltage;

a capacitor connected to the voltage multiplier circuit to store the multiplied voltage;

a transformer connected between the voltage multiplier circuit and the CMH lamp for stepping up the multiplied voltage stored by the capacitor and to supply the stepped up voltage to the lamp; and a spark gap device connected between the transformer and the capacitor to selectively discharge the stored multiplied voltage in the capacitor via the transformer to ignite or re-ignite the lamp.

3. The light source assembly of claim 2, wherein the circuit board has a first side and a second side, wherein the transformer is on the first side of the circuit board and wherein the capacitor and the spark gap device are on the second side of the circuit board.

4. The light source assembly of claim 2, wherein the housing comprises a cone-shaped electrically non-conductive base and wherein the circuit board is enclosed within the base.

5. The light source assembly of claim 4, wherein the base comprises a plastic housing sleeve supporting the circuit board.

6. The light source assembly of claim 5, wherein the circuit board has a first side and a second side, wherein the transformer is on the first side of the circuit board and wherein the capacitor and spark gap device are on the second side of the circuit board.

7. The light source assembly of claim 1, wherein the housing comprises a cone-shaped electrically non-conductive base and wherein the circuit board is enclosed within the base.

8. The light source of claim 1, wherein the screw base and the socket are a screw base and a socket compatible with a parabolic aluminized reflector (PAR) standard, and wherein only two terminals interconnect the igniter circuit and the lamp.

9. The light source of claim 8, wherein the screw base is a PAR38 screw base and wherein the socket is a PAR38 socket.

10. The light source assembly of claim 1, further comprising:

a disk, wherein the disk is positioned between the electrically insulating reflector and the circuit board for holding the circuit board in place relative to the electrically insulating reflector.

11. The light source assembly of claim 10, wherein the disk holds the circuit board orthogonally in relation thereto.

12. An igniter circuit for a light source assembly for use with a fixture having a socket connected to an external ballast circuit to generate a ballast voltage, wherein the light source assembly includes a ceramic metal halide (CMH) lamp, a screw base that engages the socket to electrically connect the light source assembly to the external ballast circuit and to conduct the ballast voltage when the screw base engages the socket, the igniter circuit comprising a circuit board having mounted thereon:

a voltage multiplier circuit for connection to the screw base and to receive the ballast voltage from the external ballast circuit via the screw base when the screw base is engaged with the socket, the voltage multiplier circuit to multiply the ballast voltage to a multiplied voltage;

a capacitor connected to the voltage multiplier circuit to store the multiplied voltage;

a transformer connected to the voltage multiplier circuit and for connection to the CMH lamp to step up the multiplied voltage stored by the capacitor and to supply the stepped up voltage to the lamp; and a spark gap device connected between the transformer and the capacitor to selectively discharge the stored voltage to iqnite or re-ignite the lamp, wherein the high voltage to energize or re-energize the lamp is contained within the electrically insulated housing and none of the high voltage is external to the light source assembly.

13. The igniter circuit of claim 12, wherein the circuit board has a first side and a second side, wherein the transformer is on the first side of the circuit board and wherein the capacitor and the spark gap device are on the second side of the circuit board.

14. The igniter circuit of claim 13, wherein the housing comprises a cone-shaped electrically non-conductive base and wherein the circuit board is enclosed within the base.

15. The igniter circuit of claim 14, wherein the base comprises a plastic housing sleeve supporting the circuit board.

16. The igniter circuit of claim 15, wherein the circuit board has a first side and a second side, wherein the transformer is on the first side of the circuit board and wherein the capacitor and spark gap device are on the second side of the circuit board.

17. The igniter circuit of claim 16, wherein the housing comprises a cone-shaped electrically non-conductive base and wherein the circuit board is enclosed within the base.

18. The igniter circuit of claim 17, wherein the screw base and the socket are a screw base and a socket compatible with a parabolic aluminized reflector (PAR) standard and wherein only two terminals interconnect the igniter circuit and the lamp.

19. The igniter circuit of claim 12, further comprising:

a disk, wherein the disk is positioned between the circuit board and an electrically insulating reflector of the light source assembly, for holding the circuit board in place relative to the electrically insulating reflector.

20. The igniter circuit of claim 19, wherein the disk holds the circuit board orthogonally in relation thereto.

* * * * *